US005465671A

United States Patent [19]

Genest

[11] Patent Number: 5,465,671

[45] Date of Patent: Nov. 14, 1995

[54] ADJUSTABLE HEIGHT TRAY STAND WITH TRAY TOY OPENING FOR EASIER LOADING/UNLOADING OF SERVICE TRAYS

[76] Inventor: Nelson J. Genest, 14 Fontaine St., Augusta, Me. 04330

[21] Appl. No.: 205,207

[22] Filed: Mar. 2, 1994

Related U.S. Application Data

[62] Division of Ser. No. 960,556, Oct. 13, 1992, Pat. No. 5,408,938.

[51] Int. Cl.[6] ..... A47B 23/00

[52] U.S. Cl. ..... 108/43; 108/147

[58] Field of Search ..... 108/106–116, 150, 108/16, 43, 147, 146; 297/4; 248/124, 414, 157, 185

[56] References Cited

U.S. PATENT DOCUMENTS

| | | | |
|---|---|---|---|
| 425,709 | 4/1890 | Schilling | 248/414 |
| 4,492,170 | 1/1985 | Solomon | 108/146 X |
| 4,653,808 | 3/1987 | Opsvik | 297/4 X |
| 4,703,701 | 11/1987 | Sema | 108/147 X |
| 4,979,718 | 12/1990 | Bauer et al. | 108/147 X |

FOREIGN PATENT DOCUMENTS

| | | | |
|---|---|---|---|
| 509118 | 2/1952 | Belgium | 108/43 |
| 731149 | 2/1943 | Germany | 108/43 |

*Primary Examiner*—José V. Chen
*Attorney, Agent, or Firm*—Stan Jones

[57] ABSTRACT

A height-adjustable, free standing tray stand having a tray-supporting surface with a cut-out section in the forward edge of the surface. Not only is it adjustable in height, it is readily set for an individual waiter's comfort during use. The tray top, when viewed from above, is "U" or horseshoe shaped and defines a forward facing opening that allows a waiter to approach the stand with a loaded tray carried from about waist to shoulder height. In use, the waiter simply moves the loaded tray over the top of the U-shaped opening which allows his arm to move between the forward facing arms of the horseshoe and lower the loaded tray until it firmly rests securely on the upper surface on top of the tray stand. The waiter may then lower his wrist, hand and arm and conveniently remove them from beneath the tray. The tray supporting surface is hinged in order to allow it to be folded down into a vertical position, and the hollow base is contoured with openings in the rear so that several bases can nest together for compact storage of the tray stands.

12 Claims, 2 Drawing Sheets

FIG 2
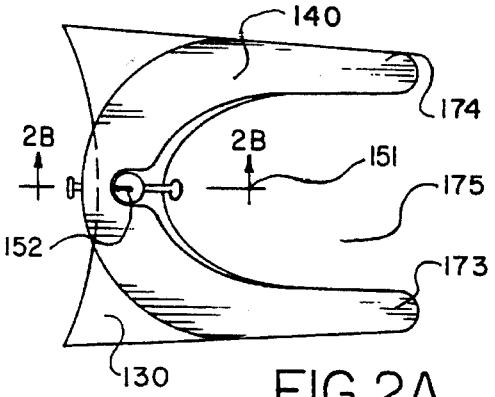
FIG 2A
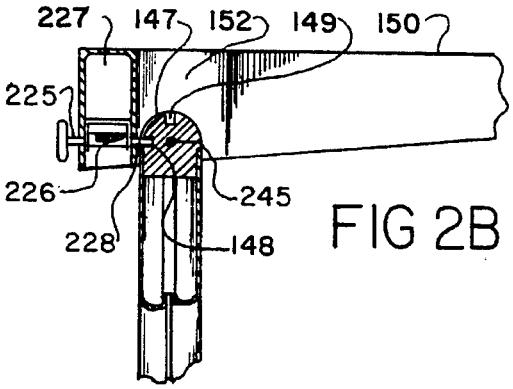
FIG 2B
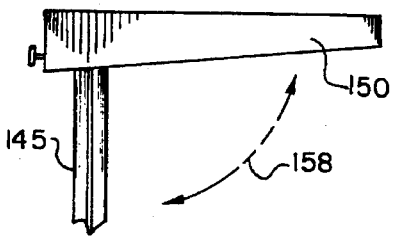
FIG 3
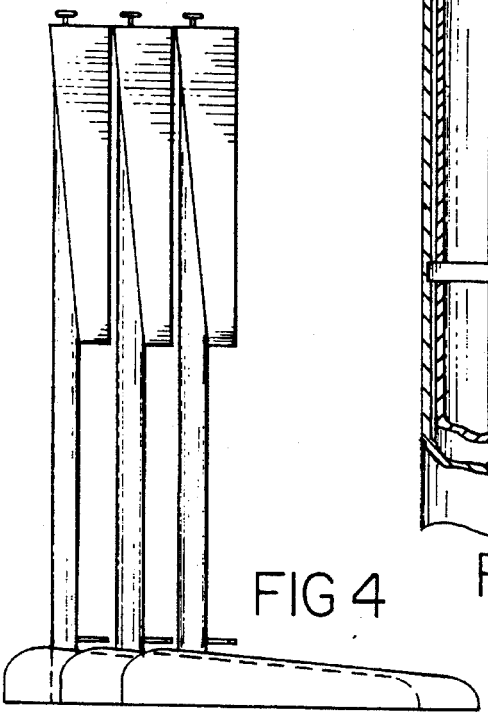
FIG 4
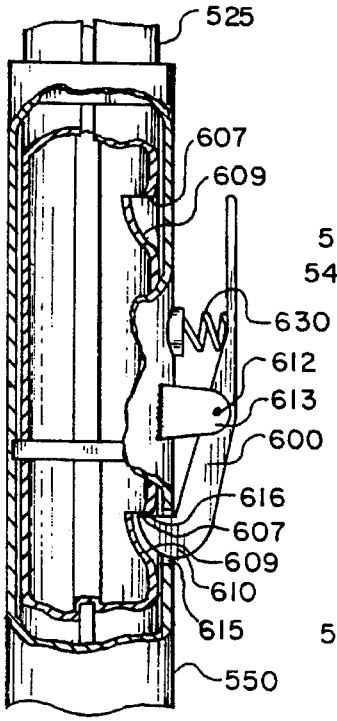
FIG 6
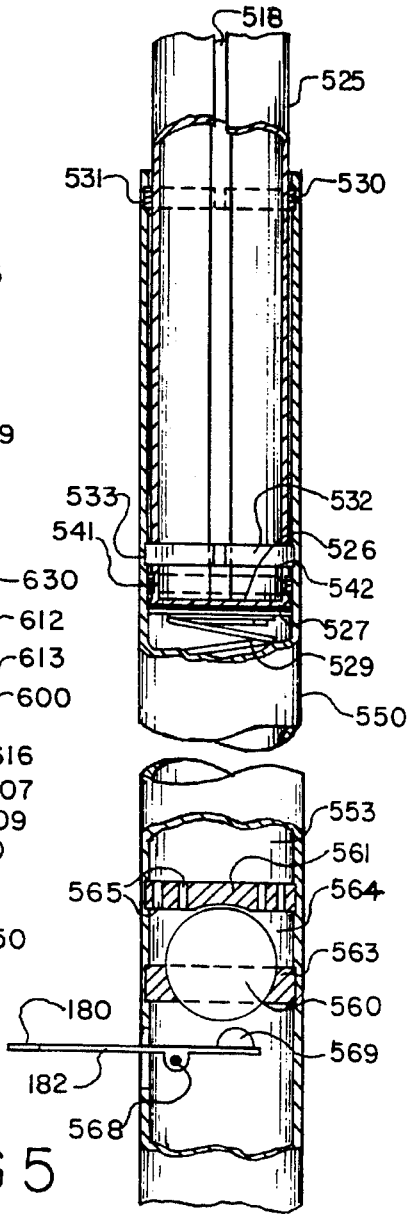
FIG 5

ADJUSTABLE HEIGHT TRAY STAND WITH TRAY TOY OPENING FOR EASIER LOADING/UNLOADING OF SERVICE TRAYS

This is a divisional application of pending U.S. application Ser. No. 07/960,556 now U.S. Pat. No. 5,408,938 for an invention entitled ADJUSTABLE HEIGHT TRAY STAND WITH TRAY TOP OPENING FOR EASIER LOADING/UNLOADING OF SERVICE TRAYS having a filing date of Oct. 13, 1992 and naming Nelson Joseph Genest as inventor.

FIELD OF THE INVENTION

The present invention relates to a new and improved tray stand, or so-called "dumb waiter", that has a forward-facing opening in a tray-receiving top which allows a waiter's hand to freely move forward into the tray receiving surface proper, securely place the tray on that surface, and then safely slide his hand, wrist and arm out from beneath the deposited tray.

More particularly, this tray stand invention relates to a free standing, adjustable height device, which provides a shoulder height support for receiving service trays without requiring the waiter to bend over. This invention provides a forward facing cut-out which allows for easier loading/unloading of service trays, and further incorporates a simple easy-to-use height adjustment in order to lower the tray, once deposited, down to a table service height.

DESCRIPTION OF PRIOR ART

Prior to the advent of this invention, small strapped folding tables have traditionally been used to hold service trays. All of us have become familiar with these folding tables that waiters and waitresses move about from table to table so that they may be used by them in serving food to customers in a restaurant. These folding tables require considerable bending down when loading and/or unloading trays. Such bending with loaded trays can lead, not only to back disorders; but additionally, the skill required to safely set up and lower the tray unto the folding table, increases the potential for spillage of the tray's contents.

The prior art for tray-receiving devices is well developed by numerous references. A search for this invention has disclosed a number of related references which have some marginal relevance to this invention and each of those prior art references will now be discussed.

Generally speaking the references from the search disclose a wide diversity in the variety of devices for holding service trays. None of the art, however, teaches or suggests the novel features of this invention.

The prior art search includes, for example, U.S. Pat. No. 128,739 to S. Mahan (1872) which discloses a lap table that is intended to provide a surface for serving food to persons confined to bed. It is designed to fit over the stomach of the person being served. It does not suggest a height adjustability nor a waiter's hand-receiving cut-out in the tray support service.

U.S. Pat. No. 3,123,935 to Williams (1964)is similar to the Mahan disclosure in that it facilitates service of food to persons confined to bed. The Williams disclosure differs from Mahan, however, in that it is a free standing unit of fixed height which is shaped such that the tray supporting surface can be positioned over a patient's bed. The new and improved tray-receiving invention of this application is height adjustable, allowing for greater flexibility in service conditions.

Although both of the above-noted prior art references are suitable for service of food to persons confined to bed, neither would be adaptable to situations where the patrons are seated in a restaurant as is the invention of this application. Nor does either prior art disclosure teach or suggest the features of this invention such as a cut-out whereby the waiter can easily and safely slide out the hand, wrist and arm (hereinafter "arm") from beneath the deposited tray.

A prior art disclosure which provides for a height adjustable bearing surface is U.S. Pat. No. 2,765,201 to Phillips (1956). The Phillips disclosure shows a free standing device whereby gypsum boards can be laid on a curved upper crossed spring surface and jacked up to ceiling height for single-worker installations. This prior art Phillips device is not suitable for the food service environment in that it is too large and would not adequately hold service trays.

Moreover the Phillips reference, is not designed to allow the waiter to move his arm fully past the tray-receiving center, deposit a tray, and then remove the arm once the tray is in place. Indeed, it is submitted that the Phillips patent, dealing as it does with building material, does not come within an art unit that is relevant to the good service industry.

Two more prior art references also disclose cut-outs for various body parts without teaching or suggesting the novel features of this invention for unobstructed tray deposit at table to shoulder height and easy adjustability for lowering the deposited tray. U.S. Pat. No. 3,565,501 t.o B. C. Bowen et al (1971) shows a vanity cabinet with a stomach-receiving cut-out in the nature of Mahan's cut out as discussed above. U.S. Pat. No. 2,112,669 to Halas (1938) discloses an adjustable height tray holding device which attaches to a beauty chair so that a customer's head may be lowered into the cut-out opening. This Halas device is used by beauty parlors for placement behind a customer's head during the dressing of the customer's hair.

Neither of these above-mentioned prior art references would be suitable for, or suggestive of, the food service environment because they can not accommodate a food service tray and do not teach or suggest an arm receiving cut-out which would facilitate the loading/unloading of a tray.

In summary then, some of the noted prior art is not readily adaptable to the food service industry and is not considered as properly relevant art. None of the disclosed references teach or suggest the several novel features of this invention which provide for easier and safer handling of food service trays. This invention thus provides a novel approach that is neither disclosed or suggested by the prior art.

SUMMARY OF THE INVENTION

It is well known to have folding tables for holding food service trays at about table height. This invention is height adjustable for individual waiters in a given waiting station within the restaurant so that loaded trays may be brought to and deposited at a selected height from about waist to shoulder height without any unnecessary stooping or bending. The actual final serving height can also be adjusted to suit the requirements of that individual server.

A tray-receiving top incorporates an "arm" (hand, wrist and arm) receiving cut-out which allows the waiter's arm to move freely beyond the geometric center of a tray receiving surface for easier deposit/removal of a service tray. The tray top can be folded to a vertical position and the bases nest together as needed for more compact and efficient storage.

OBJECTS OF THE INVENTION

It is an object of the present invention to employ a forward facing cut-out in a tray holding surface in order to allow for easier and safer loading/unloading of service trays.

It is another object of my invention to allow for adjustment of the height of the tray receiving surface. This adjustability feature allows the server to individually tailor the tray stand's height to best suit their personal needs.

It is still another object of this invention to allow for the folding of the tray receiving surface to a vertical position for easy portability. This capability to be folded also provides for more compact storage when the tray stand is not in use.

It is yet another object of this invention to provide a novel shape for the tray receiving surface that allows a safe deposit of a tray and removal of the waiter's arm without disturbing the deposited tray.

It is still a further object of this invention to allow the loaded tray to be deposited on a horseshoe-shaped tray top at about shoulder height and then simply and easily lowered by the user to table service height.

It is yet another object of this invention to allow for foot-operated lowering of a service tray from about shoulder height to table service height.

It is a still further object of this invention to provide for a simple manual adjustable height for a tray stand to suit the individual height desires of a user.

It is still one further object of this invention to provide bases that nest together for compact storage.

It is yet another object of this invention to provide for locking the tray support top in one of two positions with a simple easy to use locking/release mechanism.

BRIEF DESCRIPTION OF THE DRAWING

FIG. 2 includes FIGS. 2A and FIG. 2B. FIG. 2A is a generalized top view of the tray stand of my invention. FIG. 2B is a partial cross section of FIG. 2A at the lines indicated 2B—2B.

FIG. 3 is a side view of the tray top in horizontal position and the arrow shows its folding feature.

FIG. 4 is a generalized side view of several nesting tray stands and shows a stacking configuration for compact storage of my invention.

FIG. 5 is a partial cut away schematic view of a pneumatic height adjustment and foot-operated lowering mechanism for the tray stand of my invention.

FIG. 6 is a partial cross section of a manually adjustable upright post in accordance with this tray stand invention.

DESCRIPTION OF PREFERRED EXAMPLE EMBODIMENT AND BEST MODE OF THE INVENTION

Figure 1:
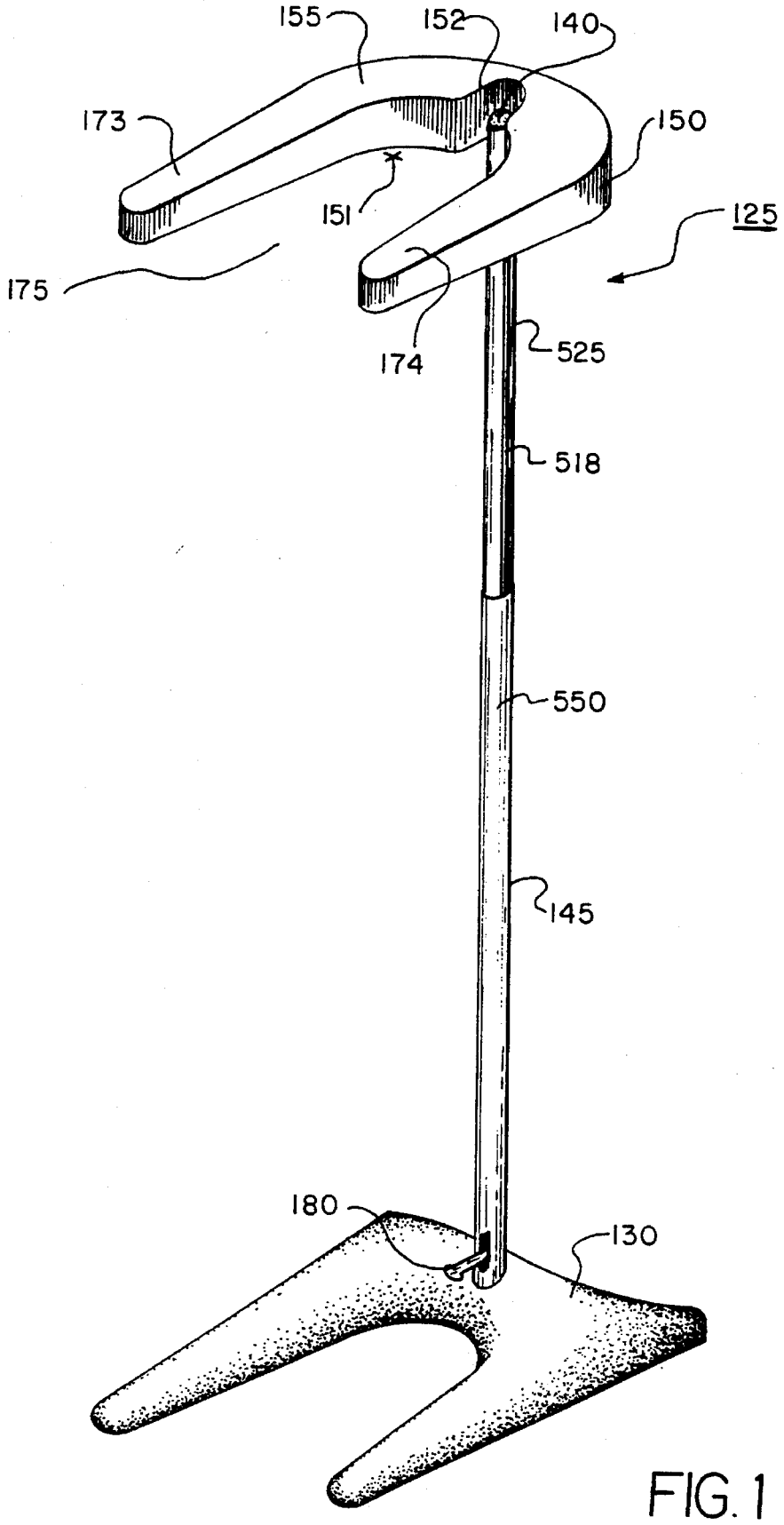
FIG. 1 is a generalized frontal view of my tray stand invention in perspective.

Turning now to the drawing, the tray stand 125 is shown in FIG. 1 as having a base 130, an upright post section 145 and a tray top 150. Tray top 150 has a flat upper surface 155 so that a service tray (not shown) may be slid into position on the upper horizontal location of surface 150.

Top 150, when viewed from above, is substantially "U" or horseshoe shaped, with two matching forward arms 173, 174 coming together at a yoke-shaped opening 140 located at the back of the horseshoe. A geometric center 151 is shown in FIGS. 1 and 2 for top 150. Yoke 140 at the rear of opening 175 includes a recess 152 which surrounds the upper portion of post 145. Recess 152 conformably surrounds the rear part of the top of post 145 and has the front of that recess extending into the opening 175 to allow forward folding of top 150 down to a vertical position as will be described in more detail hereinafter.

Ample space is left between the geometric center 151 and the yoke 180 so that a user's arm may freely enter into the space 175 beyond the center point 151 and deposit a service tray on the flat surface 155 of top 150. This tray-deposit space 175 is hereinafter sometimes referred to as a deposit of the tray on the "tray surface proper" and is available in my invention because of the horseshoe shape for my top 150 and its yoke support at the upright post 145.

Post 145 is individually adjustable in height. The overall length of post 145, when in its lower to upper position, is such that top 150 may be located anywhere from about table to shoulder height for easy unloading of a service tray. Not only is it adjustable in height, but it is readily set by an individual waiter's comfort to any one of several positions during use. Thus, the tray stand 125 of this invention is height adjustable to be tailored to the individual desires of a particular waiter in his or her station at the start of the shift.

The horseshoe shape of top 150, FIG. 2A, defines a forward facing opening 175 that allows a waiter to approach the stand 125 with a loaded tray carried at shoulder height. In use, the waiter simply moves the loaded tray over the top of opening 175 with his hand and arm moving between the forward facing arms 173, 174 of the horseshoe, beyond center 151 and lowers the loaded tray (not shown) until it firmly rests securely on the surface 155 of tray top 150. The waiter may then lower his upper arm from beneath the tray.

Post 145 is of telescoping configuration comprising an inner top section 525 telescoped within an outer lower bottom section 550. This telescoping provides an adjustability feature which readily allows a user a simple easily adjustable setting for the user's particular comfort. In one embodiment, as shown generally in FIG. 1, foot-operated pedal 180 may be depressed by the waiter so that post 145 telescopes within itself and lowers the loaded tray down to whatever height the waiter feels is a comfortable serving height for him. The patrons of the restaurant may then be served in an improved manner by use of the improved tray stand 125 of this invention.

It should be noted that the invention has allowed the waiter to serve his customers without having to bend down with a loaded tray, or do other acrobatic-like contortions that are commonly associated with the use of the prior art service tray devices.

With reference to FIG. 2B, top 150 is hinged at recess 152 in yoke opening 140 to the top of post 145 by a horizontally-located hinge pin 245 (which runs from left to right across recess 152 and is shown as a circle in cross section in FIG. 2B.). Top 150, being hinged at the upper end of post 145, may thus assume either the horizontal position as shown in FIGS. 1 and 3, or it may, as shown by arrow 158 in FIG. 3, be swivelled to a vertical rest position.

FIG. 4 shows several tray stands with the tops in a vertical rest position for compact storage when the tray stands are not in use. Dashed lines in the bases 130 of FIG. 4 show the manner in which the hollow bases 130 nest within each other in order to conserve storage space.

FIG. 2B discloses a spring loaded release pin 225 which is slidable from front to back in a slightly oversized opening which runs through the center of yoke 140 from back to front an into recess 152. Pin 225 is seated by a pre-loaded spring 226 in a release pin housing 227 with an inner locking tip 228 extending within the recess 152. The inner end 228 of pin 225 extends into a bearing relationship against a rounded crown 147 which is fixably located on the top of upright post 145. Crown 147 is rounded within a forward opening of recess 152 so that the top 150 may swivel through the ranges shown by arrow 158 in FIG. 3.

Pin 225, FIG. 2B, is spring loaded so that it bears lightly against the smoothly rounded surface of crown 147. Crown 147 includes two spaced notches 148 and 149 which are shaped to receive the end 228 of pin 225. One notch 148 is located so that the top 150 becomes locked into a horizontal position as the spring load of spring 226 forces the end 228 into notch 148. At the other extreme, when top 150 is in a vertical position, yoke 140 is now above crown 147 and pin 225 is seated into notch 149.

Pin 225 provides an automatic engagement feature in this tray stand invention in order to automatically lock top 150 in either a vertical or horizontal position. The user simply pulls release pin 225 until end 228 is free from the notches 148 or 149 to change the position for top 150. Releasing pin 225 will again allow it to lock into either of notches 148 or 149.

FIG. 5 includes a partial cross sectional view of a pneumatic mechanism for the tray stand 125 of this invention. FIG. 6 discloses a suitable manual adjustment for controlling the height of this tray stand to suit the individual needs of the user. Either of these, or indeed any other suitable height adjustment mechanism, including a screw jack and battery operated motor may be employed without departing from the scope and spirit of this invention.

It is not my intention to limit the appended claims to the particular height adjustments as shown provided that the selected adjustment device suitably allows for a range of tray heights; and provides, if desired, a way of lowering the loaded tray, once deposited, down to about table service height. Indeed, the prior art discussed in the introductory section of this application discloses several height adjustment mechanisms such as screw jacks and the like which would be suitable for application in my invention. I, however, have found particular benefits from the pneumatic and manual approaches disclosed and claimed herein without limiting the broader aspect of the principles underlying my invention.

In FIG. 5, two sections 525, 550 of post 145 are disclosed telescoped within each other in an airtight configuration somewhat reminiscent of a hand operated tire pump. Thus, upper telescope section 525 is machined with a slightly smaller diameter than the inside dimensions of section 550 so that section 525 is slidable within the innermost diameter of lower section 550. Upper section 525 also has a pair of opposed inwardly recessed spinal grooves 518 running axially along its length.

The inward grooves 518 are likewise selected to have a dimension with respect to a mated pair of inwardly directed rails provided on the inside of lower section 550 so that the two sections are properly aligned and easily slide relative to one another without any binding and prevent the top section from spinning relative to the base.

In the pneumatic embodiment of FIG. 5, an upper spacing collar 530 is seated into an annular recessed groove 531 which is located on the inside and near the top of section 550. The groove and collar 530, 531 serve as a spacer in order to further assure that the two sections 525 and 550 will slide freely relative to each other. Spacer 530, if viewed from above, also has two opposed inwardly directed tabs that are slightly smaller than the axial recessed grooves 518 running longitudinally along the length of upper section 525. These inwardly spaced tabs keep the top section from spinning relative to the base and also assure a more stable tray stand. A similar lower spacing collar 532 is also located in another groove 533 which serves purposes similar to that of collar 530.

Inner section 525, at its base, carries an annular stop collar 541 which is located in an annular receiving groove 542. The function of stop collar 541 is to prevent the two sections from becoming separated as the stand is adjusted to its highest point. Note that the stop collar is carried on the outside of the inner section 525 and bears against the inner surface of the lower section 550, while the lower collar 532 is carried on the inner surface of section 550 and bears against the outer surface of section 525. These two collars thus extend inwardly beyond each other and they will butt together thus preventing accidental separation of the two sections 525 and 550.

The bottom of section 525 is capped by a base 526 and below that base 526 is located a sealing gasket 527 that forms an airtight seal with the inner surface of outer section 550. Spring 529 is suitably fastened to the base 526 by rivets or otherwise, and acts as a shock absorber should the inner section 525 be dropped suddenly.

This pneumatically adjustable tray stand may be further understood by assuming that the user is moving the upper section 525 to a higher location such as, for example, shoulder height. The airtight seal 527 slides within the inner side of section 550 and provides a suction which in turn creates a vacuum in the lower chamber designated 553. This suction, in turn, lifts sealing ball 560 away from its lower ball seat 563 and up against the upper ball stop platform 561. With ball 560 in the upper location against platform 561, air enters the space between the bali's lower ball seat 563 into the ball housing chamber 564.

Platform 561 is provided with a series of vertical air passageways 564 therethrough which communicate between chamber 564 and chamber 553. Thus, air entering into the ball chamber 564 also enters through holes 565 into the vacuum space of chamber 553. As the user selects his desired height for the tray stand and releases the upper section 525, the suction stops and gravity causes the ball 560 to drop back into its seat 563. With ball 560 in sealing engagement against the ball seat 563 a column of air has been trapped within the two chambers 563 and 564. This trapped column of air prevents the upper section 525 from going any lower and thus the height selected by the user has been attained.

This pneumatic upright post 145 with its trapped column of air prevents any further inadvertent lowering of the top 150 below that selected by the user. Moreover, any range of height is readily available to the waiter who controls the lowering of the tray stand to the height that he desires for service to his patrons. In the manner just described the tray stand of this invention has been originally elevated to shoulder height for easy unloading of a tray full of food to be served. Tray top opening 175 provides an easy unobstructed deposit of the loaded tray unto the tray-receiving surface and then the waiter simply lowers the ray top to service height by foot-pedal 180.

Foot-pedal 180, FIG. 5, is pinned at a pivot location 568 on the inside of lower section 550 near the base 130, FIG. 1. Depressing the outer end of foot-pedal 180 raises the inside end of lever 182, FIG. 5, which carries a raised button 569 at the other end thereof. The foot-pedal lever 182 is pivoted about fulcrum 568 such that the button 569 touches the bottom of ball 560 and removes ball 560 from its seat 563 allowing the trapped air column to escape. Without trapped air being present in the chambers 553 and 564, the weight of the upper section 525 and the loaded tray top 150 causes the tray to slowly and gently drop down to the desired height when foot-pedal 180 is released.

From the above-described operation it is clear that the upper height adjustment for the pneumatic model tray stand is done manually, while the lowering operation is done essentially automatically by depression of the foot-pedal 180 by the user. This mode of operation leaves the user's hands free to go about the important function of serving his customers while improving his overall safety from back strain and other similar ailments. The pneumatic air lock for holding the desired height with a foot-pedal release is a novel feature which is claimed hereinafter as a user-adjustable height air lock.

FIG. 6 discloses another embodiment of the tray stand invention wherein raising and lowering of the telescoping sections of the upright post 145 are done manually by the user. In FIG. 6, inner upper section 525 is again smaller in diameter than the outer, lower section 550. In this embodiment the user grasps the upper section 525 and lifts it up from the base 130 and the lower section 550.

In this FIG. 6 embodiment, the two sections 525, 550 need not be air-tight with respect to each other; but need only be machined in size relative to each other so that they slide easily under a manual height adjustment. A manually operable hand-operated ratchet and pawl mechanism is used for height adjustment in the tray stand of FIG. 6. Ratchet arm 600 is positioned at a height that is easily reached and convenient for hand operation by the user.

For an upward adjustment, a plurality of inwardly depressed ramps 609 are provided on the inside of section 525 in alignment with an opening 615 in the outer section 550. An outer ratchet arm 600 is secured at its mid-point by pin 612 in a fulcrum housing 613 that is secured by rivets or otherwise near the upper end of section 550. A ratchet head 610, secured at fulcrum 613 above the opening 615, is urged by a compressed spring 630 to pass through the opening 615. As shown, the lower surface of head 610 is rounded for smooth engagement with the inclined surfaces of ramps 609. Accordingly head 610 rides along these ramps 609 without any locking taking place. Thus, as the user lifts upper section 525, ratchet head 610 is urged outwardly by each ramp incline 609 as the user lifts the inner section 525 to a higher elevation for tray stand 125.

The upper side 616 of head 610, however, is flat with an inwardly depending engaging surface that is mated to lock with similarly shaped flat horizontal locking surfaces 607 located on the inner surface of inner section 525. When a lower elevation for tray stand 125 is desired by the user, he simply overrides the spring 630, disengages the locking pawl surface 616 from a mating surface 607 and lowers the upper section 525 to a new height. Release of the pawl 600 will again cause it to lock into engagement with the two flat surfaces 615 and 607.

While my invention has been described with reference to a particular example of preferred embodiments, it is my intention to cover all modifications and equivalents within the scope of the following appended claims. It is therefore requested that the following claims be given a liberal interpretation which is within the spirit and scope of my contribution to this art.

What is claimed is:

1. A portable, self-standing tray stand used while serving food to restaurant customers by resting a service tray on an upper surface of a tray-supporting top, which top has, relative to the user, a forward facing cut-out section that allows an extended hand and arm of the user to enter beyond the forward edge of the top and into the top's cut-out section in order to deposit a tray thereon while allowing the user's hand to remain essentially at the center of gravity for said tray, said stand comprising:

a base section;

an adjustable rigid upright post section extending upwardly from said base section from about table height to about a user's shoulder height;

means for trapping a column of air within said post as said post is manually lifted;

pneumatic air lock means for maintaining said post at a lifted position in response to said trapped column of air;

a flat horizontal, rigid tray-receiving top mounted on the upper end of said upright post section, with said rigid top having a flat, rigid, horizontal upper tray-receiving surface constructed of material capable of supporting a loaded service tray resting thereon, and said rigid top further having a forward facing cut-out section extending from the forward edge of the top back beyond a center point for said top;

arm receiving means defined by said cut-out section in said rigid top for allowing a user's hand and arm to freely enter past said forward facing front edge of said top and into said cut-out section near said center point thereof, in order to deposit a tray on said flat, tray-receiving surface, and to withdraw his hand and arm without disturbing a deposited tray which rests on said flat surface of said rigid top; and said post comprising means for controllably releasing some of the air within said trapped column of air and thereby lowering said post in response to a user-operated air release height adjustment for said post.

2. A tray stand in accordance with claim 1 wherein the post is adjustable in height by a user manually raising the height of said top, and said tray stand is further characterized by a user-operated lowering mechanism, and said tray stand further comprises:

said post comprises two telescoping airtight sections which are slidable relative to one another;

said pneumatic air lock includes an airtight seal between the telescoping sections that creates a suction as one section is moved relative to the other; and said means for controllably releasing some of the trapped air may be controlled by the user's foot as the user manually bleeds off the air from within said trapped column of air.

3. Apparatus in accordance with claim 1 wherein the top of said tray stand, viewed from above, is "U" shaped with two forward facing arms joined by a rear yoke section, and the tray is mounted to said post section, said apparatus further comprising:

means for connecting the top at said yoke to the upper end of said post so that the top is mounted to the top of said post with freedom to rotate; and top positioning means allowing the top to rotate upward/downward in a forward direction through a range of rotational movement from a vertical position to a horizontal position.

4. A method of using the structure of claim 3 wherein the base is also essentially U-shaped with two forward facing legs as the sides of the U and the yoke, or closed portion of the U, being the rear of the base, said base being hollow and provided with openings at the rear of said base aligned with the legs thereof, and said method comprising the steps of:

swinging the top of each of at least two of said tray stands to a vertical position; and inserting the forward facing legs of at least one tray stand into said hollow space through the rear openings in the base of another of said tray stands so that the tray stands nest closely together for more compact storage.

5. A tray stand in accordance with claim 1 wherein said upright post includes two telescoped sections fitting within and slidable relative to each other, and wherein said means for controllably releasing some of said trapped air is further characterized in that:

said pneumatic air lock means is co-operatively connected between the telescoped sections for holding said telescoped sections at a selected height; and said stand further comprises:

means for manually setting the height of said post by said user at desired height locations in accordance with the amount of air trapped by said air trapping means.

6. A tray stand in accordance with claim 5 wherein the post is adjustable in height by a user raising the height of said top, and said tray stand is further characterized by a user-operated lowering mechanism, and said tray stand further comprises:

an airtight seal between the telescoping sections, which seal creates a suction as one section is slid relative to the other; and said pneumatic air lock means includes a ball in a ball seat, which ball is seated as a closed air valve to trap said column of air and may be controllably opened by the user to release some of the trapped air as the user manually bleeds off air from said trapped column of air during said selective lowering step.

7. A method of loading and unloading service trays on a portable, self-standing tray stand comprising the steps of:

mounting a manually adjustable upright post section extending upwardly from a base section;

providing a flat horizontal tray-receiving top mounted on the upper end of said upright post section, with said top having a flat upper tray-receiving surface and a forward facing arm receiving means in the form of a yoked cut-out section in said top with said cut-out extending from the forward edge of the top back beyond the geometric center thereof and forming a yoke section rearward of the arm receiving means;

sizing said cut-out in said tray top with an opening that allows a user's hand and arm to freely enter past the forward facing arm receiving means of said top with said cut-out allowing the user to deposit a tray on the flat surface proper of said tray top surface;

positioning said support post on the underside of the yoke section of said tray top;

separating said support post into two airtight telescoped sections, one of which is slidably fitted within the other;

manually adjusting the height of said top to a selected position;

locking a trapped column of air within said telescoped post sections by said manually lifting step; and lowering the top from said raised position by controllably releasing some of said trapped air in response to a user-actuated foot pedal.

8. A method in accordance with claim 7 which further comprises the steps of:

adjusting said upright post in height from among a range of adjustable height positions; and loading/unloading said tray at a selected position which avoids unnecessary bending or stooping by a user when loading and/or unloading trays on said tray stand.

9. A method in accordance with claim 8 wherein said post includes two telescoped sections slidably fitting within each other, and further characterized in that:

manually adjusting a lock/release means connected between the telescoped sections; and selectively setting the height of said post at a desired location.

10. A method in accordance with claim 9 and further characterized in that:

creating a suction that draws a column of air within said slidable post sections by manually lifting the tray top to a raised location;

trapping said column of air between said telescoped sections in order to hold said top at said raised location: and controllably releasing some of said trapped air by opening a pneumatic air lock which is connected between said telescoped sections in order to lower said top.

11. A method in accordance with claim 10 wherein the step of controllably releasing some of said trapped air is further characterized by the step of;

operating a foot pedal which releases some of the trapped air in order to control the amount of air bled off from said trapped air column.

12. A service tray stand mounted on an adjustable height upright post which is connected to a base section, said tray stand having a tray top mounted on the upper end of said upright post, with said tray top having a flat upper tray-receiving surface and said tray stand is used in accordance with the method comprising the steps of:

shaping said tray top when viewed from above to be in essentially a U or horseshoe shape having two forward facing and spaced arms forming the sides of the U and joined by a yoke section as the closed portion of said U shape;

providing a forward facing arm receiving means in said tray top between said two spaced arms of sufficient breadth and depth to allow a user to approach the tray stand carrying a hand-held tray, said arm receiving means being an opening providing sufficient space such that the user may freely insert and remove his fore arm in said opening to place and/or remove a service tray on said tray-receiving surface;

depositing the center of the tray on a sufficient portion of the flat tray receiving surface and over the arm receiving opening therein such that said tray will be securely received by said surface and will remain seated thereon as the user removes his hand from beneath the tray and removes his forearm from the arm receiving opening;

adjusting said upright post in height so that the user can select the height of said tray stand from a range of height positions for depositing and/or removing said tray without unnecessary bending or stooping by a user;

trapping a column of air in said upright post at said adjusted height by said adjusting step; and pneumatically holding said trapped column of air at said desired adjustment achieved during the adjusting step when said upright post is at a height selected by the user.

* * * * *